US007170220B2

(12) United States Patent
Hideshima et al.

(10) Patent No.: US 7,170,220 B2
(45) Date of Patent: Jan. 30, 2007

(54) SHADOW MASK WITH SLOTS HAVING A FRONT SIDE OPENING WITH AN INCLINED FROM SIDE EDGE

(75) Inventors: Hirofumi Hideshima, Tokyo-To (JP); Hiroki Oka, Tokyo-To (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 11/246,532

(22) Filed: Oct. 11, 2005

(65) Prior Publication Data

US 2006/0082280 A1 Apr. 20, 2006

(30) Foreign Application Priority Data

Oct. 15, 2004 (JP) ..... 2004-301630

(51) Int. Cl.
*H01J 29/70* (2006.01)

(52) U.S. Cl. ..... 313/403; 313/402

(58) Field of Classification Search ..... 313/402, 313/403, 404, 405, 406, 407, 408
See application file for complete search history.

(56) References Cited

U.S. PATENT DOCUMENTS 4,168,450 A * 9/1979 Yamauchi et al. ..... 313/403
4,429,028 A * 1/1984 Kuzminski ..... 430/5

FOREIGN PATENT DOCUMENTS

JP U 61-177353 11/1986
JP A 01-320738 12/1989
JP A 05-006741 1/1993
JP A 2001-068019 3/2001

OTHER PUBLICATIONS

U.S. Appl. No. 11/246,529, filed Oct. 11, 2005, Hideshima et al.
U.S. Appl. No. 11/248,193, filed Oct. 13, 2005, Hideshima et al.

* cited by examiner

*Primary Examiner*—Karabi Guharay
*Assistant Examiner*—Anthony Perry
(74) *Attorney, Agent, or Firm*—Oliff & Berridge, PLC

(57) ABSTRACT

In a shadow mask 21, a large number of slots 23 are made in a mask body 22 in the horizontal direction X and in the vertical direction Y. Each slot 23 has a roughly rectangular backside opening 33, a roughly rectangular front-side opening 32, and a through-hole 31 that connects these two openings 33, 32. Of the multiple slots 23 made in the mask body 22, the slots 23 situated at least in those areas of the mask body 22 that are surrounded by a horizontal axis 24 and two diagonal axes 26, 27 that pass through the center point 28 of the mask body 22 have such front-side openings 32 that a pair of the upper and lower short sides 32*c*, 32*d* of the rectangular outline of the front-side opening 32 of each slot 23 are inclined, relative to the horizontal axis 24, along the radiate line 61 radiating from the center point 28 of the mask body 22 toward the slot 23. The angle of inclination β of the short sides 32*c*, 32*d* is preferably in the range of a α±10°, where α is the angle between the radiate line 61 radiating from the center point 28 of the mask body toward the slot 23 and the horizontal axis 24.

4 Claims, 6 Drawing Sheets

SHADOW MASK WITH SLOTS HAVING A FRONT SIDE OPENING WITH AN INCLINED FROM SIDE EDGE

BACKGROUND OF THE INVENTION

1. Field of the Invention

The present invention relates to a shadow mask for forming roughly rectangular beam spots on a fluorescent screen of a color cathode ray tube.

2. Background Art

A shadow mask 1 is mounted in a color cathode ray tube 101 with its surface facing to a fluorescent screen 102 of the color cathode ray tube 101, as shown in FIG. 8. In the color cathode ray tube 101, electron beams 105 emitted from electron guns 103, deflected by the magnetic fields produced by a deflection yoke 104, pass through the shadow mask 1 and then accurately strike predetermined points on the fluorescent screen 102.

The details of the shadow mask 1 are as follows. FIG. 4 is a diagrammatic plane view illustrating the positional relationship between the slots made in the shadow mask 1. As shown in this figure, the shadow mask 1 comprises a mask body 1*a* that is roughly rectangular in shape, and a large number of slots 2 (including slots 2*a*, 2*b*, 2*c*, and 2*d*) are arranged in this mask body 1*a* in the horizontal direction X and in the vertical direction Y in the plane view, each slot having a roughly rectangular through-hole that penetrates the mask body 1*a* in the direction of thickness. In this Specification, a unit structure composed of a through-hole, and a front-side opening and a backside opening that form the through-hole is referred to as a "slot". Further, in FIG. 4, reference numeral 6 denotes a center (also referred to as a "center point") that is the intersection of two diagonal axes 5, 5 connecting the opposite corners of the mask body 1*a*, extending along the mask body 1*a* plane; reference numeral 3, a horizontal axis passing through the center 6, extending along the mask body 1*a* plane; and reference numeral 4, a vertical axis passing through the center 6, extending along the mask body 1*a* plane. Furthermore, in FIG. 4, reference numeral 2*a* denotes a slot situated in the center 6 of the mask body 1*a*; reference numeral 2*b*, slots situated in the outer end part of the vertical axis 4; reference numeral 2*c*, slots situated in the outer end part of the horizontal axis 3; and reference numeral 2*d*, slots situated in the outer end part of each diagonal axis 5. FIG. 4 is merely a diagrammatic view, and the slots shown in this figure are dimensionally exaggerated.

When such a shadow mask 1 is placed in the color cathode ray tube 101 shown in FIG. 8 with the surface of the shadow mask 1 facing to the fluorescent screen 102 of the color cathode ray tube 101, the electron beams 105 emitted from the electron guns 103 vertically enter the slot 2*a* situated in the center of the shadow mask 1 but obliquely enter, at angles θ, the slots 2*b*, 2*c*, and 2*d* that are situated in the outer end parts of the respective axes (the horizontal axis 3, the vertical axis 4, and the diagonal axes 5), that is, in the peripheral part of the shadow mask 1. For this reason, in the shadow mask 1, the positions of the front-side opening and the backside opening that form a slot are adjusted according to the position of the slot in the mask body.

FIGS. 5A, 5B, 5C and 5D are diagrammatical plane views showing the shape of the slots 2 (slots 2*a*, 2*b*, 2*c* and 2*d*) made in the respective parts of the mask body 1*a* of the shadow mask 1. In these figures, reference numeral 11 denotes through-holes of the slots 2. The through-holes 11 are made so that they connect the front-side openings 12 and the backside openings 13 that are etched in a thin metal sheet. The backside openings 13 are made on the side on which electron beams 7 are incident, and the front-side openings 12 are made on the side from which the electron beams 7 emerge. The backside openings 13 and the front-side openings 12 are made roughly rectangular in shape, and the front-side openings 12 are made large in area so that they do not obstruct the passage of the electron beams 7.

Since electron beams enter, from the front, the slot 2*a* situated in the center of the mask body 1*a*, the through-hole 11 (the backside opening 13) of this slot is made so that it is positioned almost in the center of the front-side opening 12, as shown in FIG. 5A. FIG. 5B shows the slot 2*b* situated in the outer end part of the vertical axis 4; FIG. 5C, the slot 2*c* situated in the outer end part of the horizontal axis 3; and FIG. 5D, the slot 2*d* situated in the outer end part of the diagonal axis 5. Electron beams 7 obliquely enter the slots 2*b*, 2*c*, and 2*d* that are situated in the peripheral part of the mask body 1*a*. Therefore, in order not to obstruct the passage of the electron beams 7 that have passed through the through-hole 11 of each slot, the front-side opening 12 is made so that its position is offset from the position of the through-hole 11 (the backside opening 13) to the peripheral part side in the mask body 1*a*.

However, even when the offset arrangement as shown in FIG. 5 (such an arrangement that the position of the front-side opening 12 of a slot 2 is offset from the position of the through-hole 11 (the backside opening 13) according to the position of the slot 2 in the mask body 1*a*) is made, of the slots 2*b*, 2*c* and 2*d* made in the peripheral part of the mask body 1*a*, especially the slots 2*d* situated in the outer end part of each diagonal axis 5 have the shortcoming that, since electron beams 7 that have obliquely entered the slots 2*d* are partially blocked by the sidewalls of the front-side openings 12 and the backside openings 13 of these slots, the slots 2*d* cannot let the electron beams 7 strike the fluorescent screen of the cathode ray tube to form thereon beam spots in the desired shape.

In order to overcome this problem, shadow masks having such a structure that, of the two long sides of a roughly rectangular through-hole of each slot made in a mask body, the long side situated on the side apart from the center of the mask body has a protrudent part protruding in the direction opposite to the vertical axis of the mask body, from at least one of the upper and lower end parts of this long side, have been proposed in Japanese Laid-Open Patent Publications No. 320738/1989 and No. 6741/1993.

FIG. 6 is a plane view showing the shape of the slots in the conventional shadow mask described in Japanese Laid-Open Patent Publication No. 6741/1993. This figure shows the shape of the slot 2*d* situated in the upper-right outer end part of the diagonal axis 5 extending toward the upper right in the plane view of the mask body 1*a* (FIG. 4). This slot 2*d* has the following features: the position of the front-side opening 12 is offset from the position of the through-hole 11 (the backside opening 13) to the upper right, that is, to the peripheral part side, and, at the same time, of the two long sides of the through-hole 11, the long side situated on the right side, that is, on the peripheral part side, has a protrudent part 11*a* protruding toward the peripheral part side from the lower end part of this long side. Further, the front-side opening 12 of the slot 2*d* is made to have a roughly rectangular outline composed of a pair of left- and right-hand long sides 12*a*, 12*b* and a pair of upper and lower short sides 12*c*, 12*d*.

Incidentally, cathode ray tubes have came to be made flat in recent years, like the flat-type color cathode ray tube shown in FIG. 8. In such a flat-type color cathode ray tube, therefore, the angles θ at which electron beams 7 enter the slots 2 made in the shadow mask 1, especially those slots 2 situated in the peripheral part of the shadow mask 1, have come to be significantly great, and such a phenomenon that electron beams 7 that have passed through the through-holes 11 of the slots 2 are partially blocked by the sidewalls of the front-side openings 12 of the slots 2 occurs. For example, as shown in FIG. 6, although an electron beam 7*a* that has passed through the lower part of the through-hole 11 of the slot 2*d* situated in the outer end part of the diagonal axis 5 emerges from the slot 2*d* without striking the front-side opening 12 of this slot, an electron beam 7*b* that has passed through the upper part of the through-hole 11 of the slot 2*d* is partially blocked by the sidewall of the front-side opening 12 of this slot at a site encircled by the dotted line 8.

FIG. 7 is a sectional view taken along line VII—VII in FIG. 6 for explaining the above-described phenomenon. As shown in this figure, the front-side opening 12 of the slot 2*d* is composed of sidewalls 14, 15, the backside opening 13 of the slot 2*d* is composed of sidewalls 16, 17, and the through-hole 11 connects the front-side opening 12 and the backside opening 13. As shown in FIG. 7, in such a slot 2*d*, when an electron beam 7*b* that has passed through the upper part of the through-hole 11 passes through the front-side opening 12, a part of this electron beam 7*b* strikes the peripheral-part-side sidewall 15 of the front-side opening 12 and is thus blocked by the sidewall 15 at a site encircled by the dotted line 8 shown in FIG. 6. Occurrence of this phenomenon causes the following problems: the electron beam 7*b* that has passed through the slot 2*d* gets defective; the luminance is lowered; and the electron beams 7 cannot strike a fluorescent screen of a cathode ray tube to form thereon roughly rectangular beam spots in the desired size and shape.

SUMMARY OF THE INVENTION

The present invention was accomplished in the light of the aforementioned problems in the prior art. An object of the present invention is therefore to provide a shadow mask having a slot structure that can, as much as possible, prevent electron beams that have passed through the through-holes of slots from being blocked by the front-side openings of the slots even when the electron beams enter the slots at increased angles.

The present invention provides a shadow mask that comprises a mask body in which a large number of slots are made in the horizontal and vertical directions and that allows electron beams to form roughly rectangular beam spots on a fluorescent screen of a cathode ray tube, each one of the slots made in the mask body having a roughly rectangular backside opening on the side on which electron beams are incident, a roughly rectangular front-side opening on the side from which electron beams emerge, and a through-hole that connects the backside opening and the front-side opening with each other, the mask body having a center point situated in the center of the mask body plane, and a horizontal axis and two diagonal axes that pass through the center point and extend along the mask body plane, and, of the multiple slots made in the mask body, the slots situated at least in those areas of the mask body that are surrounded by the horizontal axis and the two diagonal axes having such front-side openings that, of a pair of the upper and lower short sides of the rectangular outline of the front-side opening of each slot, the upper short side situated on the side opposite to the horizontal axis side being inclined, relative to the horizontal axis, along the radiate line radiating from the center point toward the slot.

In the present invention, it is preferable that the upper short side, situated on the side opposite to the horizontal axis side, of the rectangular outline of the front-side opening of each slot situated in the above-specified areas of the mask body be inclined at an angle in the range of $\alpha \pm 10°$, where $\alpha$ is the angle between the radiate line radiating from the center point toward the slot and the horizontal axis.

Further, in the present invention, it is preferable that the mask body has a large number of slots in the above-specified areas of the mask body, and that, of a pair of the upper and lower short sides of the rectangular outline of the front-side opening of each one of the multiple slots in the specified areas of the mask body, the upper short side situated on the side opposite to the horizontal axis side forms, with an imaginary line extending in parallel with the horizontal axis, an angle that is greatest in the slots situated on the diagonal axes and gradually becomes smaller either continuously or step-wise as the slot position gets apart from the diagonal axes.

Furthermore, in the present invention, it is preferable that, of a pair of the upper and lower short sides of the rectangular outline of the front-side opening of each slot situated in the specified areas of the mask body, not only the upper side situated on the side opposite to the horizontal axis side but also the lower side situated on the horizontal axis side be inclined, relative to the horizontal axis, along the radiate line radiating from the center point of the mask body toward the slot. Also in this case, it is preferable that the lower short side, situated on the horizontal axis side, of the rectangular outline of the front-side opening of each slot situated in the above-specified areas of the mask body be inclined at an angle in the range of $\alpha \pm 10°$, where $\alpha$ is the angle between the radiate line and the horizontal axis. Further, it is preferable that the mask body has a large number of slots in the above-specified areas of the mask body, and that, of a pair of the upper and lower short sides of the rectangular outline of the front-side opening of each one of the multiple slots in the specified areas of the mask body, the lower short side situated on the horizontal axis side forms, with an imaginary line extending in parallel with the horizontal axis, an angle that is greatest in the slots situated on the diagonal axes and gradually becomes smaller either continuously or step-wise as the slot position gets apart from the diagonal axes.

Furthermore, in the present invention, it is preferable that the mask body has a large number of slots in the above-specified areas of the mask body, that the front-side openings and the backside openings of the multiples slots situated in the specified areas of the mask body be made by an etching process, and that between the front-side openings of each two multiple slots situated in the specified areas of the mask body, arranged adjacently to each other in the direction parallel to the vertical axis passing through the center point of the mask body, extending along the mask body plane, be present a bridge portion remaining after the etching step.

According to the present invention, the slots situated at least in those areas of the mask body that are surrounded by the horizontal axis and the two diagonal axes have such front-side openings that, of a pair of the upper and lower short sides of the rectangular outline of each front-side opening, at least the upper short side situated on the side opposite to the horizontal axis side is inclined, relative to the horizontal axis, along the radiate line radiating from the center point of the mask body at a predetermined angle of inclination (e.g., an angle in the range of $\alpha \pm 10°$, where $\alpha$ is the angle between the radiate line and the horizontal axis), so that the inclination of a pair of the upper and lower short sides of the front-side opening of each slot situated at least in those areas of the mask body that are surrounded by the two diagonal axes and the horizontal axis becomes almost the same as that of electron beams. It is, therefore, possible to prevent electron beams from being partially blocked by the peripheral-part-side sidewalls of the front-side openings. Consequently, a shadow mask having such a slot structure can prevent, to the utmost, electron beams that have passed through the through-holes of the slots from being blocked by the front-side openings of the slots even when the electron beams enter the slots at increased angles, and can let the electron beams strike a fluorescent screen of a cathode ray tube to form thereon beam spots in the desired size and shape (e.g., roughly rectangular), while keeping the luminance high.

Further, according to the present invention, by making the front-side openings of the multiples slots so that, of a pair of the upper and lower short sides of the rectangular outline of each front-side opening, the upper short side situated on the side opposite to the horizontal axis side forms, with an imaginary line extending in parallel with the horizontal axis, an angle that is greatest in the slots situated on the diagonal axes and gradually becomes smaller either continuously or step-wise as the slot position gets apart from the diagonal axes, it is possible to make the angle of inclination of at least the upper short side, situated on the side opposite to the horizontal axis side, of the front-side opening of each slot almost the same as the angle at which electron beams enter the slot. Consequently, the shadow mask of the present invention can prevent, to the utmost, electron beams that have passed through the through-holes of the slots from being blocked by the front-side openings of the slots.

DETAILED DESCRIPTION OF PREFERRED EMBODIMENTS

Embodiments of the present invention will be described with reference to the accompanying drawings. The present invention is not limited to the following embodiments and encompasses a variety of other embodiments that are within the technical concept of the present invention.

First Embodiment

First of all, a shadow mask according to a first embodiment of the present invention will be described with reference to FIGS. 1A and 1B.

Figure 1A:
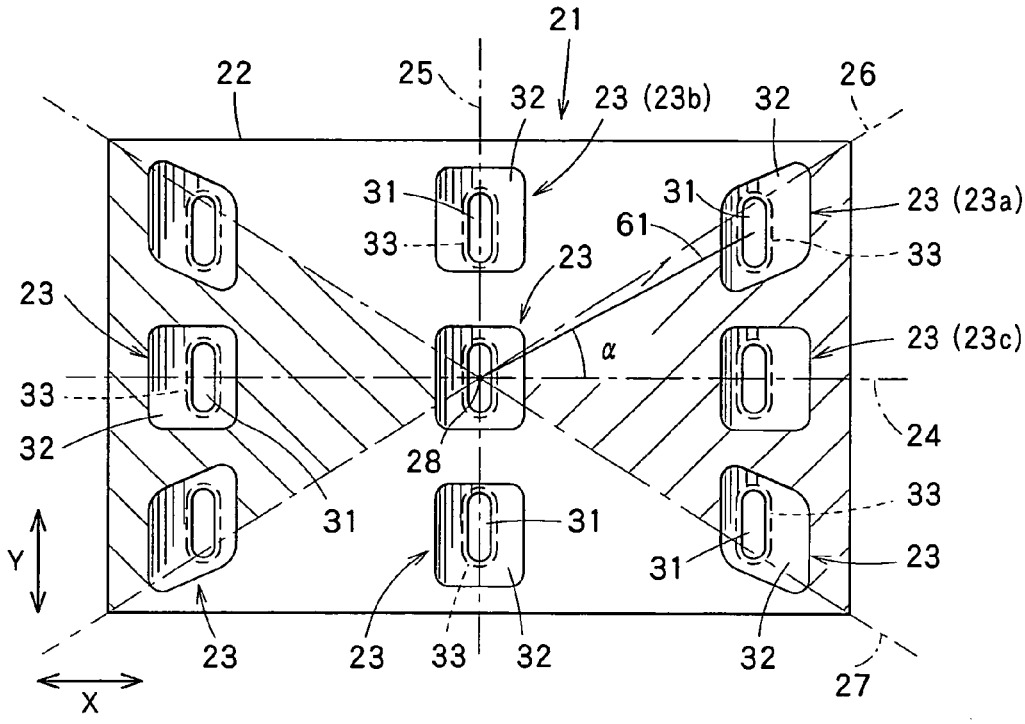
FIG. 1A is a plane view showing a shadow mask according to a first embodiment of the present invention.
Figure 1B:
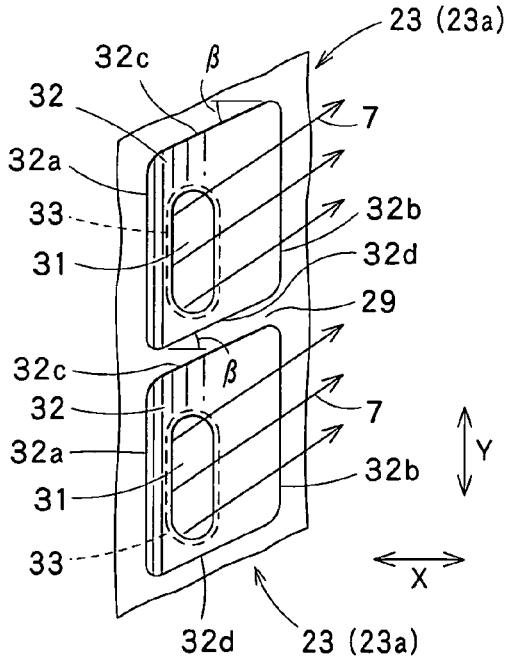
FIG. 1B is an enlarged plane view showing an example of the shape of slots made in the outer end part of the diagonal axis of the shadow mask shown in FIG. 1A.
Figure 4:
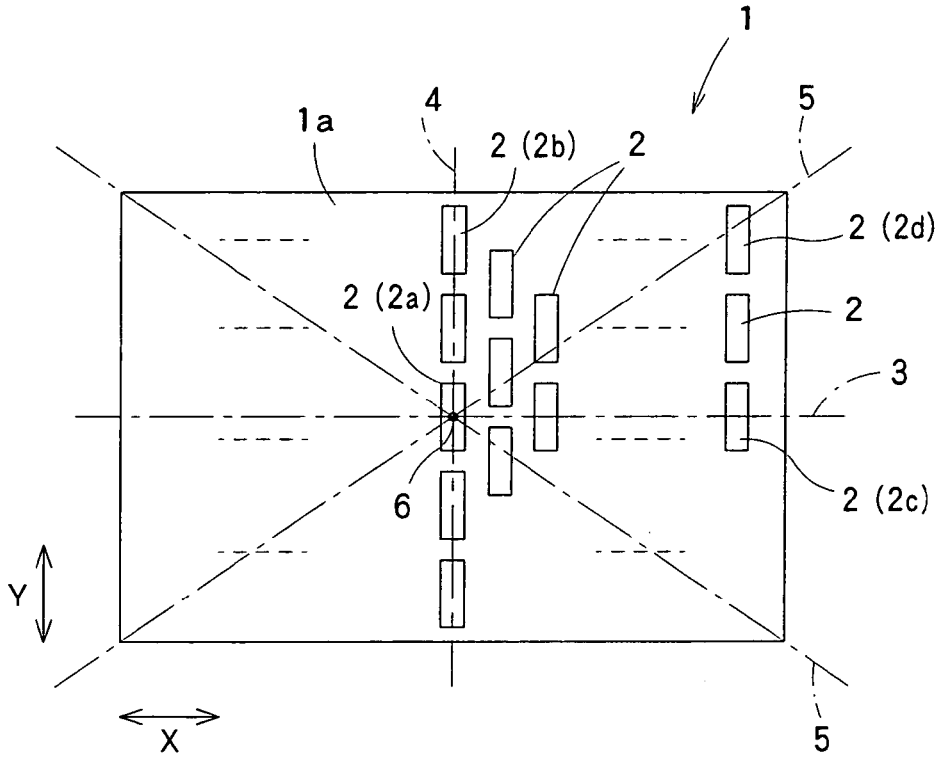
FIG. 4 RELATED ART
FIG. 4 is a diagrammatic plane view illustrating the relationship between the slots made in various parts of a shadow mask.
Figures 5A, 5B, 5C, 5D:
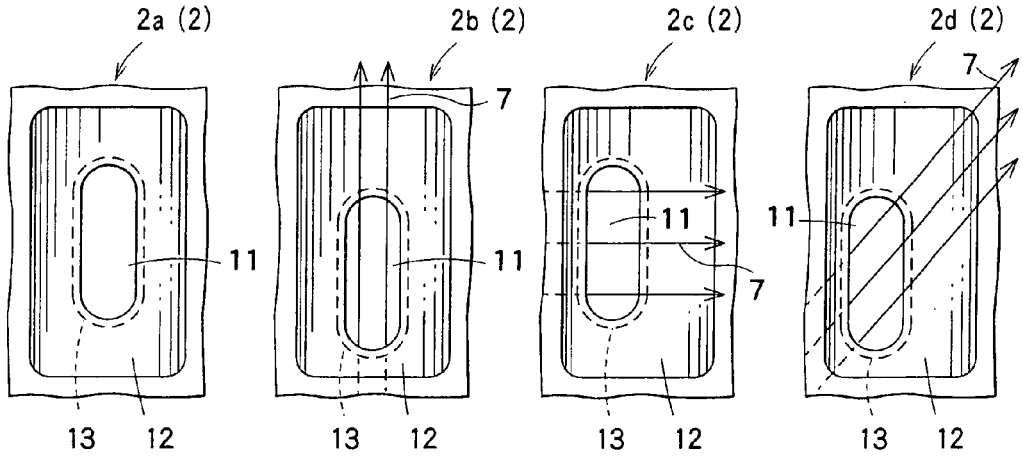
FIG.5A RELATED ART FIG.5B RELATED ART FIG.5C RELATED ART FIG.5D RELATED ART
FIGS. 5A, 5B, 5C and 5D are diagrammatic plane views showing the shape of the slots made in various parts of a shadow mask.

As shown in FIGS. 1A and 1B, a shadow mask 21 according to the first embodiment of the present invention comprises a mask body 22 that is roughly rectangular in shape, and this mask body 22 has a large number of slots 23 (including slots 23*a*, 23*b*, 23*c*) with roughly rectangular through-holes 31 penetrating the mask body 22 in the direction of thickness. The through-hole 31 of each slot 23 is made so that it connects a front-side opening 32 and a backside opening 33 that are etched in a thin metal sheet. Further, a large number of the slots 23 are arranged in the manner shown in FIG. 4 on the mask body 22 plane in the horizontal direction X and in the vertical direction Y. When mounted in a cathode ray tube, such a shadow mask 21 acts not only to shield electromagnetic waves but also to let electron beams strike a fluorescent screen of the cathode ray tube to form thereon roughly rectangular beam spots. In FIG. 1A, reference numeral 28 denotes a center point that is the intersection of two diagonal axes 26, 26 connecting the opposite corners of the mask body 22, extending along the mask body 22 plane; reference numeral 24, a horizontal axis passing through the center 28, extending along the mask body 22 plane; and reference numeral 25, a vertical axis passing through the center 28, extending along the mask body 22 plane. FIG. 1A is merely a diagrammatic view, and the slots shown in this figure are dimensionally exaggerated.

In the shadow mask 21 according to the first embodiment of the present invention, of the multiple slots 23 made in the mask body 22, the slots 23 situated at least in those areas of the mask body 22 (the crosshatched areas in FIG. 1A) that are surrounded by the horizontal axis 24 and the two diagonal axes 26, 27 have such front-side openings 32 that a pair of the upper and lower short sides 32*c*, 32*d* of the rectangular outline of each front-side opening 32 are inclined, relative to the horizontal axis 24, along the radiate line 61 radiating from the center point 28 of the mask body 22 toward the slot 23 at a predetermined angle of inclination, as shown in FIG. 1B. More specifically, the angle of inclination (see symbol $\beta$ in FIG. 1B) of a pair of the upper and lower short sides of the rectangular outline of each front-side opening 32 is preferably in the range of $\alpha \pm 10°$, where $\alpha$ is the angle between the radiate line 61 radiating from the center point 28 of the mask body 22 and the horizontal axis 24.

The backside openings 33 of the slots 23 are made on the side on which electron beams are incident, and the front-side openings 32 of the slots 23 are made on the side from which electron beams emerge. These backside openings 33 and front-side openings 32 are made roughly rectangular in shape.

Figure 7:
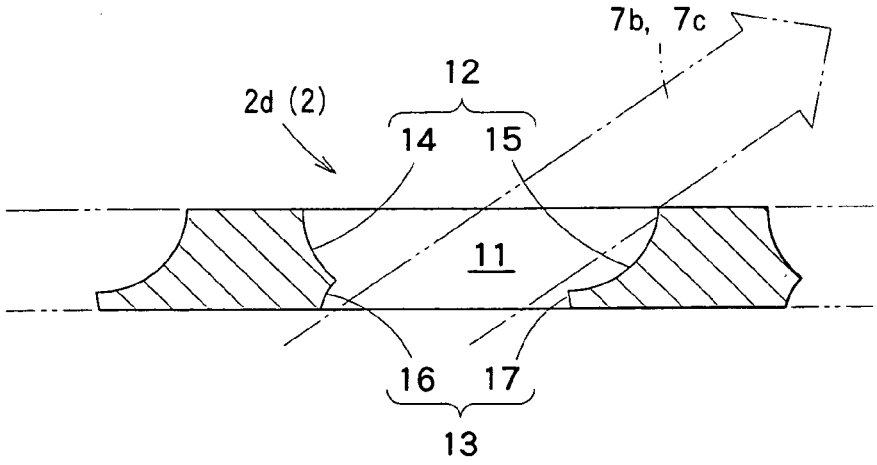
FIG. 7 RELATED ART
FIG. 7 is a sectional view taken along line VII—VII in FIG. 6, showing the behavior of electron beams.

The front-side opening 32 of each slot 23 is composed of sidewalls (see reference numerals 14, 15 in FIG. 7), and is made to have a large area so that it does not obstruct the passage of electron beams. Further, as shown in FIG. 1B, a narrow bridge portion 29 remaining after the etching step is present between the front-side openings 32 of each two slots 23 that are arranged adjacently in the vertical direction Y (in the direction in which the vertical axis 25 extends). The shadow mask 21 comprising the mask body 22 that includes the bridge portions 29 remaining after the etching step is excellent in mechanical strength. Such a shadow mask is advantageous in that it can be produced with a higher yield because it is scarcely deformed in press molding. Moreover, since this shadow mask shows good durability when it is dropped, it is advantageous also in that it is highly reliable in quality.

The front-side openings 32 of the slots 23 vary in position relative to the through-hole 31 (the backside opening 33), depending on the position of the slot 23 in the mask body 22. Namely, in the slot 23 situated at the center point 28 of the mask body 22, the front-side opening 32 is made so that the through-hole 31 (the backside opening 33) is positioned in its center. On the other hand, those slots 23 situated in the outer end part of the horizontal axis 24 are made so that the position of the front-side opening 32 is gradually offset from the position of the through-hole 31 (the backside opening 33) to the peripheral part side as the position of the slot 23 gets apart from the center 28. Similarly, those slots 23 situated in the outer end part of the vertical axis 25 are made so that the position of the front-side opening 32 is gradually offset from the position of the through-hole 31 (the backside opening 33) to the peripheral part side as the position of the slot 23 gets apart from the center 28.

Figure 8:
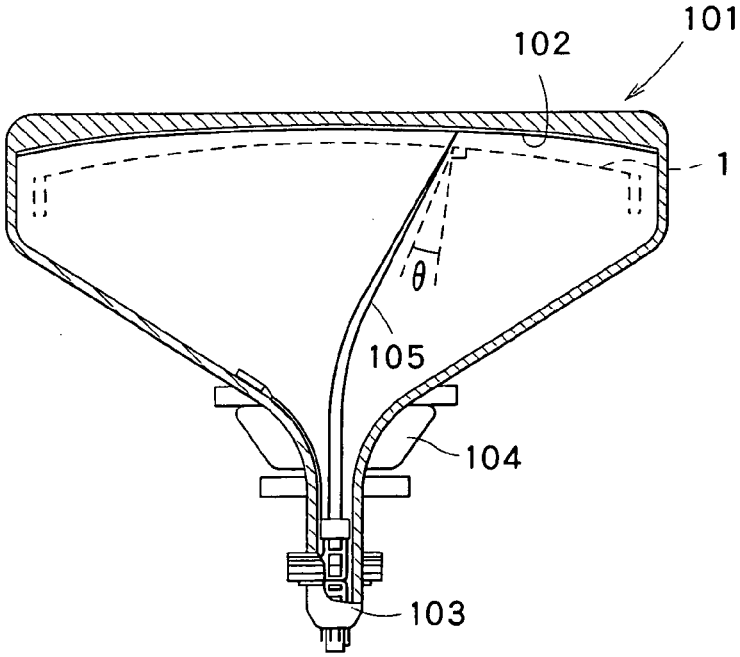
FIG. 8 RELATED ART
FIG. 8 is a sectional view showing the basic structure of a flat-type color cathode ray tube in which a shadow mask is incorporated.

The above description is applicable also to those slots 23 that are situated on or along the diagonal axes 26, 27; that is, these slots 23 are made so that the position of the front-side opening 32 is gradually offset from the position of the through-hole 31 (the backside opening 33) to the peripheral part side as the position of the slot 23 gets apart from the center 28. For example, as shown in the plane view (FIG. 1A) of the mask body 22, the slots 23 on the diagonal axis 26 are made so that the position of the front-side opening 32 is gradually offset from the position of the through-hole 31 (the backside opening 33) to the right-hand side and upward (that is, to the upper right) as the position of the slot 23 gets apart from the center 28 toward the upper right, while that the position of the front-side opening 32 is gradually offset from the position of the through-hole 31 (the backside opening 33) to the left-hand side and downward (that is, to the lower left) as the position of the slot 23 gets apart from the center 28 toward the lower left. The same is true for those slots 23 situated on the other diagonal axis 27. The amount of the offset varies according to the angle θ at which electron beams 7 obliquely enter the slots 23 (see FIG. 8), and is determined so that electron beams that have passed through the through-holes 31 are not partially blocked by the sidewalls (see reference numeral 15 in FIG. 7) of the front-side openings 32.

In the shadow mask 21 according to the first embodiment of the present invention, the slots 23 situated at least in those areas of the mask body 22 that are surrounded by the horizontal axis 24 and the two diagonal axes 26, 27 (the crosshatched areas in FIG. 1A) have such front-side openings 32 that a pair of the upper and lower sides 32*c*, 32*d* of the rectangular outline of the front-side opening 32 of each slot 23 are inclined at an angle (see symbol β in FIG. 1B) in the range of α±10°, where α is the angle between the radiate line 61 radiating from the center point 28 of the mask body 22 toward the slot 23 and the horizontal axis 24, as mentioned above.

Namely, as shown in FIG. 1B, the front-side openings 32 of the slots 23 are made roughly rectangular in shape, the rectangular outline of each front-side opening 32 being composed of a pair of left- and right-hand longs sides 32*a*, 32*b* extending in the vertical direction Y (in the direction in which the vertical axis 25 extends) and a pair of upper and lower short sides 32*c*, 32*d* that intersect the long sides 32*a*, 32*b*. A pair of the upper and lower short sides 32*c*, 32*d* extend almost in the transverse direction (almost in the direction in which the horizontal axis 24 extends) but are inclined at an angle in the range of α±10°, where α is the angle between the radiate line 61 radiating from the center point 28 of the mask body 22 and the horizontal axis 24.

Further, at least in the above-specified areas of the mask body 22, a pair of the upper and lower sides 32*c*, 32*d* of the rectangular outline of the front-side opening 32 of each slot 23 are made almost parallel to each other, as shown in FIG. 1B. Furthermore, each two slots 23, 23 to be positioned adjacently in the vertical direction Y are made so that the lower short side 32*c* of the upper slot 23 faces to the upper short side 32*d* of the lower slot 23, and that these short sides 32*c*, 32*d* are almost parallel to each other.

The front-side openings 32 of the multiple slots 23 may also be made so that a pair of the upper and lower short sides 32*c*, 32*d* of the rectangular outline of each front-side opening 32 (see symbol β in FIG. 1B) forms, with an imaginary line extending in parallel with the horizontal axis 24, an angle that is greatest in the slots 23 situated on the diagonal axes 26, 27 and gradually becomes smaller either continuously or step-wise as the slot position gets apart from the diagonal axes 26, 27.

Thus, the front-side openings 32 of the slots 23 situated at least in the above-specified areas of the mask body 22 are in such a shape that a pair of the upper and lower short sides 32*c*, 32*d* of the rectangular outline of each front-side opening 32 are inclined at an angle in the range of α±10°, where α is the angle between the radiate line 61 radiating from the center point 28 of the mask body 22 and the horizontal axis 24, so that the inclination, relative to the horizontal axis 24, of a pair of the upper and lower short sides 32*c*, 32*d* of the rectangular outline of the front-side opening 32 of the slot 23 becomes greater as the position of the slot 23 gets apart from the horizontal axis 24 upwardly or downwardly. On the other hand, the angle of inclination, relative to the horizontal axis 24, of electron beams that enter the shadow mask 21 becomes greater as the point the electron beams strike gets apart from the horizontal axis 24 upwardly or downwardly, and the electron beams inclined at such angles enter the slots 23 from their backside openings 31. Therefore, at least in the above-specified areas of the mask body 22, each slot 23 situated in a position apart from the horizontal axis 24 upwardly or downwardly has a front-side opening 32 whose upper and lower short ends 32*c*, 32*d* are inclined at almost the same angle as the angle of inclination of electron beams that enter the slot 23. Consequently, electron beams coming in the slots 23 barely strike the sidewalls of the front-side openings 32 of the slots 23, and the electron beams that have passed through the through-holes 31 can pass through the front-side openings 32 without becoming defective.

Figure 6:
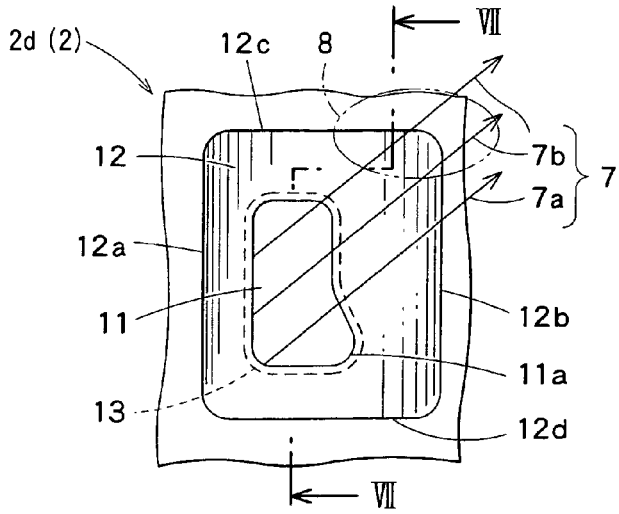
FIG.6 RELATED ART
FIG. 6 is a plane view showing the shape of slots made in a conventional shadow mask.

Thus, according to the shadow mask 21 of the first embodiment of the present invention, in the front-side openings 32 of the slots 23 made at least in those areas of the mask body 22 that are surrounded by the horizontal axis 24 and the two diagonal axes 26, 27 (the crosshatched areas in FIG. 1A), a pair of the upper and lower short sides 32*c*, 32*d* of the rectangular outline of each front-side opening 32 are inclined, relative to the horizontal axis 24, along the radiate line 61 radiating from the center point 28 of the mask body 22 at a predetermined angle of inclination (an angle in the range of $\alpha \pm 10°$, where $\alpha$ is the angle between the radiate line 61 and the horizontal axis 24). For this reason, the inclination of a pair of the upper and lower short sides 32*c*, 32*d* of the rectangular outline of the front-side opening 32 of each slot 23 situated at least in those areas of the mask body 22 that are surrounded by the two diagonal axes 26, 27 and the horizontal axis 24 becomes almost the same as the inclination of electron beams. It is, therefore, possible to minimize the partial blocking of electron beams 7 by the peripheral-part-side sidewall of each front-side opening 32 at a site encircled by the dotted line 8 in FIG. 6, for example. Consequently, the shadow mask 21 having such a slot structure can prevent, to the utmost, electron beams 7 that have passed through the through-holes 31 of the slots 23 from being blocked by the front-side openings 32 of the slots 23 even when the angles $\theta$ (see FIG. 8) at which the electron beams 7 enter the shadow mask 21 are made greater, and can let the electron beams 7 strike a fluorescent screen of a cathode ray tube to form thereon beam spots in the desired size and shape (e.g., roughly rectangular), while keeping the luminance high.

Further, according to the shadow mask 21 of the first embodiment of the present invention, by making the front-side openings 32 of the multiple slots 23 so that a pair of the upper and lower short sides 32*c*, 32*d* of the rectangular outline of each front-side opening 32 forms, with an imaginary line extending in parallel with the horizontal axis 24, an angle (see symbol $\beta$ in FIG. 1B) that is greatest in the slots 23 situated on the diagonal axes 26, 27 and becomes smaller either continuously or step-wise as the slot position gets apart from the diagonal axes 26, 27, it is possible to make the angle of inclination of a pair of the upper and lower short sides 32*c*, 32*d* of the front-side opening 32 of each slot 23 almost the same as the angle of inclination of electron beams that enter the slot 23. Consequently, the shadow mask 21 can prevent, to the utmost, electron beams that have passed through the through-holes 31 of the slots 23 from being blocked by the front-side openings 32 of the slots 23.

Furthermore, according to the shadow mask 21 of the first embodiment of the present invention, of a pair of the upper and lower short sides 32*c*, 32*d* of the rectangular outline of the front-side opening 32 of each one of the multiples slots 23, not only the short side 32*c* situated on the side opposite to the horizontal axis 23 side, but also the short side 32*d* situated on the horizontal axis 23 side may be inclined, relative to the horizontal axis 24, along the radiate line 61 radiating from the center point 28 of the mask body 22 at a predetermined angle of inclination, and, moreover, each two slots 23 to be positioned adjacently in the vertical direction Y are made so that the lower short side 32*c* of the upper slot 23 and the upper short side 32*d* of the lower slot 23 are almost parallel to each other. For this reason, it becomes possible to properly set the slot pitch, the size of the front-side openings 32, and so on, while keeping the mechanical strength of the mask body 22 high by making, sufficiently large, the width of a bridge portion 29 that is formed between each two slots 23 arranged adjacently in the vertical direction Y.

In the shadow mask 21 according to the above-described first embodiment, although, of the multiple slots 23 made in the mask body 22, the slots 23 situated at least in those areas of the mask body 22 that are surrounded by the horizontal axis 24 and the two diagonal axes 26, 27 (the crosshatched areas in FIG. 1A) have such front-side openings 32 that a pair of the upper and lower sides 32*c*, 32*d* of the rectangular outline of each front-side opening 32 are inclined relative to the horizontal axis 24, it is not always necessary that a pair of the upper and lower sides 32*c*, 32*d* of the rectangular outline of the front-side opening 32 of each slot 23 situated in the other areas of the mask body 22 (i.e., the non-crosshatched areas in FIG. 1A) be inclined. It is, however, desirable that the multiple slots successively existing between the slots 23*a* situated in the outer end parts of the diagonal axes 26, 27 and the slots 23*b* situated in the outer end part of the vertical axis 25 be made so that the inclination of a pair of the upper and lower sides of the rectangular outline of the front-side opening 32 gradually varies from the inclination of a pair of the upper and lower sides of the rectangular outline of the front-side opening 32 of each slot 23*a* to the inclination of a pair of the upper and lower sides of the rectangular outline of the front-side opening 32 of each slot 23*b*. The same is true for the relationship between the slots 23*a* situated in the outer end parts of the diagonal axes 26, 27 and the slots 23*c* situated in the outer end part of the horizontal axis 24.

Figure 2:
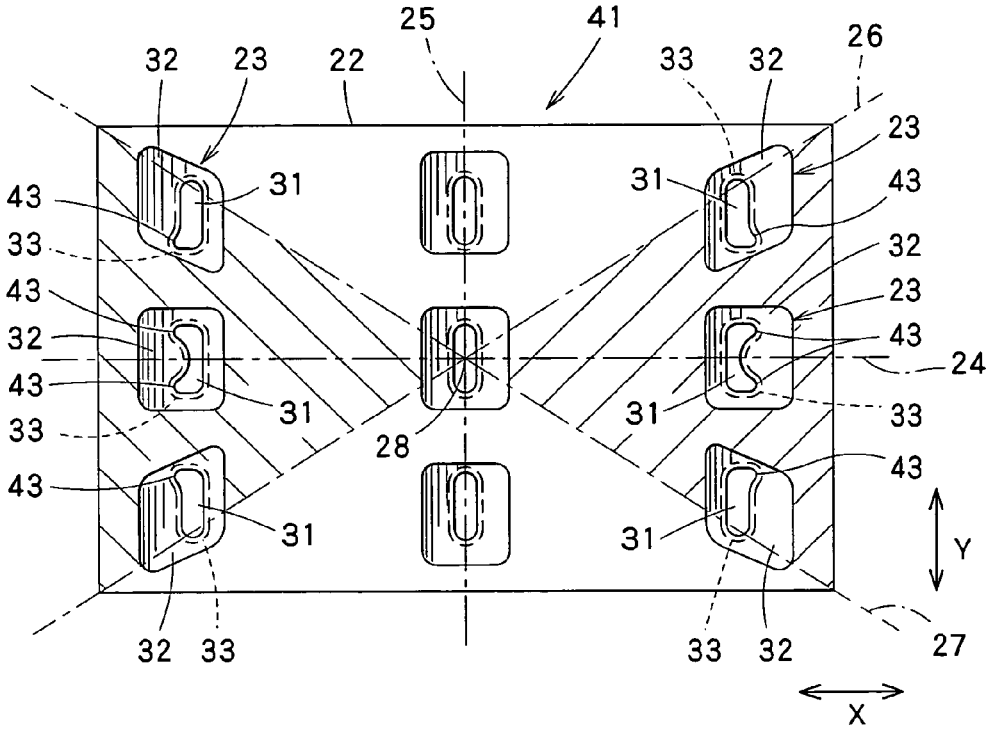
FIG. 2 is a plane view showing another example of the shadow mask according to the first embodiment of the present invention.

Furthermore, although the through-holes 31 of the slots 23 made in the mask body 22 of the shadow mask 21 according to the above-described first embodiment are roughly rectangular in shape, they may be in any other shape. Specifically, for example, like a shadow mask 41 shown in FIG. 2, the rectangular through-hole 31 comes to have a protrudent part 43 protruding from at least one end part of its long side situated on the peripheral part side, as the slot position gets apart from the center point 28 in the horizontal direction. Namely, in the slots 23 situated in the vicinity of the diagonal axes 26, 27, the through-holes 31 are made to have one protrudent part 43 protruding from the horizontal-axis-side end part of the long side, situated on the peripheral part side, of each through-hole 31. Further, in the slots 23 situated in the vicinity of the horizontal axis 24, the through-holes 31 are made to have two protrudent parts 43 protruding from both end parts of the long side, situated on the peripheral part side, of each through-hole 31. If the protrudent parts 43 are made in the through-holes 31 in the above-described manner, electron beams that have passed through the through-holes 31 form, on a fluorescent screen of a cathode ray tube, beams spots excellent in shape.

Second Embodiment

Next, a shadow mask according to the second embodiment of the present invention will be described with reference to FIGS. 3A and 3B. The second embodiment of the present invention is almost the same as the first embodiment shown in FIGS. 1A and 1B, except that, of a pair of the upper and lower short sides of the rectangular outline of the front-side opening of each slot, only the short side situated on the side opposite to the horizontal axis side is inclined relative to the horizontal axis. Throughout FIGS. 1A and 1B that show the first embodiment and the FIGS. 3A and 3B that show the second embodiment, like reference characters designate like or corresponding parts, and those parts that have been described already in connection with the first embodiment will not be described in detail any more in the following description of the second embodiment.

Figure 3A:
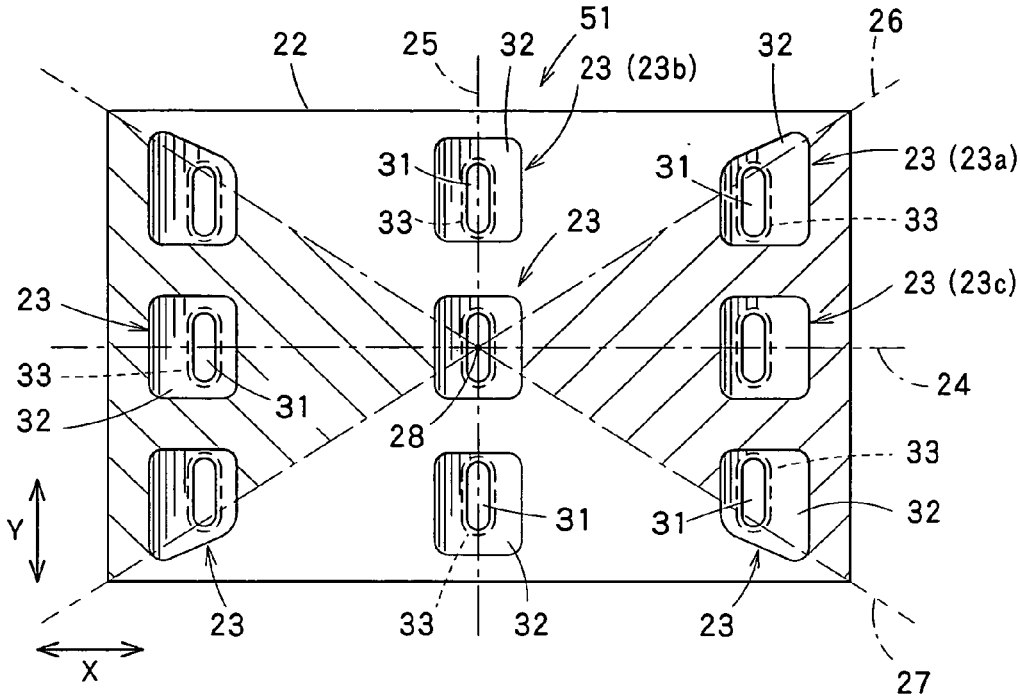
FIG. 3A is a plane view showing a shadow mask according to a second embodiment of the present invention.
Figure 3B:
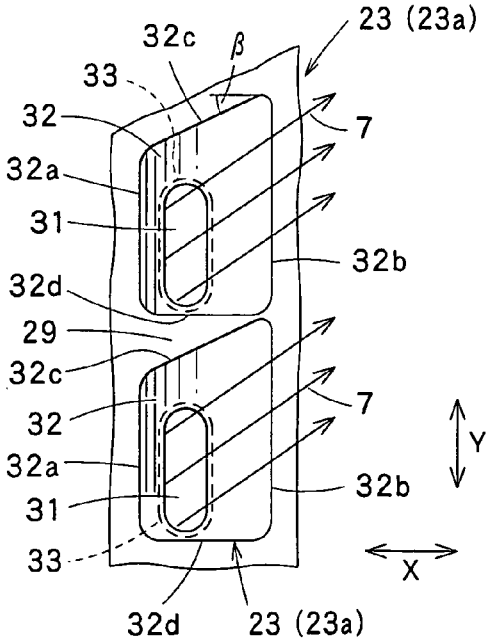
FIG. 3B is an enlarged plane view showing an example of the shape of slots made in the outer end part of the diagonal axis of the shadow mask shown in FIG. 3A.

As shown in FIGS. 3A and 3B, a shadow mask 51 according to the second embodiment of the present invention has the same structure as that of the shadow mask 21 shown in FIGS. 1A and 1B, and in the front-side openings 32 of the slots 23 situated at least in those areas of the mask body 22 that are surrounded by the horizontal axis 24 and the two diagonal axes 26, 27 (the crosshatched areas in FIG. 3A), of a pair of the upper and lower short sides 32*c*, 32*d* of the rectangular outline of each front-side opening 32, only the short side 32*c* situated on the side opposite to the horizontal axis 24 side is inclined, relative to the horizontal axis 24, along the radiate line 61 radiating from the center point 28 of the mask body 22 at a predetermined angle of inclination. More specifically, it is preferable that the angle of inclination of the side 32*c* of the rectangular outline of each front-side opening 32 (see symbol $\beta$ in FIG. 3B) be in the range of $\alpha \pm 10°$, where $\alpha$ is the angle between the radiate line 61 radiating from the center point 28 of the mask body 22 and the horizontal axis 24. Of a pair of the upper and lower short sides 32*c*, 32*d* of the rectangular outline of the front-side opening 32 of each slot 23, the short side 32*d* on the horizontal axis side 24 is made parallel to the horizontal axis 24.

Thus, according to the shadow mask 51 of the second embodiment of the present invention, in the front-side openings 32 of the slots 23 situated at least in those areas of the mask body 22 that are surrounded by the horizontal axis and the two diagonal axes 26, 27, of a pair of the upper and lower short sides 32*c*, 32*d* of the rectangular outline of each front-side opening 32, the upper short side 32*c* situated on the side opposite to the horizontal axis 24 side is inclined, relative to the horizontal axis 24, along the radiate line 61 radiating from the center point 28 of the mask body 22 at a predetermined angle of inclination (an angle in the range of $\alpha \pm 10°$, where $\alpha$ is the angle between the radiate line 61 and the horizontal axis 24). Therefore, there can be obtained the same actions and effects as those of the shadow mask 21 according to the aforementioned first embodiment. Consequently, the shadow mask 51 having the above-described slot structure can prevent, to the utmost, electron beams 7 that have passed through the through-holes 31 of the slots 23 from being blocked by the front-side openings of the slots 23 even when the electron beams 7 enter the shadow mask 51 at increased angles $\theta$, and can let the electron beams 7 strike a fluorescent screen of a cathode ray tube to form thereon beam spots in the desired size and shape (e.g., roughly rectangular), while keeping the luminance high.

(Process for Producing Shadow Masks According to First and Second Embodiments)

A typical process for producing the shadow masks 21, 41, 51 according to the above-described first and second embodiments will be described hereinafter. It is needless to say that the shadow masks of the present invention are not limited to ones produced by the following manufacturing process.

It is possible to produce the shadow masks 21, 41, 51 according to the aforementioned first and second embodiments by the following conventionally known process.

Namely, to produce the shadow masks 21, 41, 51, a photo-etching process using a continuous in-line system is usually employed. Specifically, for example, an aqueous colloidal photoresist or the like is applied to both surfaces of a thin metal sheet and dried. Thereafter, a photomask with a pattern of the aforementioned front-side openings 32 is brought into close contact with the front surface of the metal sheet, and a photomask with a pattern of the above-described backside openings 33 is brought into close contact with the back surface of the metal sheet. This one is exposed to ultraviolet light emitted from a high mercury vapor pressure lamp or the like and then developed with water. The positional relationship between the photomask with a pattern of the front-side openings 32 and the photomask with a pattern of the backside openings 33, and the shape of these photomasks are designed with consideration for the positional relationship between the front-side openings 32 and backside openings 33 of the slots 23 in the resulting shadow masks 21, 41, 51, and the size of the openings.

The bare-metal portions of the thin metal sheet, surrounded by the resist film after development, are made into the above-described shapes by changing the etching speed. After conducting heat treatment, etc., the etching step is effected by spraying a ferric chloride solution over both surfaces of the metal sheet, for example.

Thereafter, the post-treatment steps such as rinsing with water and stripping are successively conducted. Thus, there are finally obtained the shadow masks 21, 41, 51 according to the above-described first and second embodiments.

The invention claimed is:

1. A shadow mask that comprises a mask body in which a large number of slots are made in the horizontal and vertical directions and that allows electron beams to form roughly rectangular beam spots on a fluorescent screen of a cathode ray tube, each one of the slots made in the mask body having a roughly rectangular backside opening on the side on which electron beams are incident, a roughly rectangular front-side opening on the side from which electron beams emerge, and a through-hole that connects the backside opening and the front-side opening with each other, the mask body having a center point situated in the center of the mask body plane, and a horizontal axis and two diagonal axes that pass through the center point and extend along the mask body plane, and of the multiple slots made in the mask body, the slots situated at least in those areas of the mask body that are surrounded by the horizontal axis and the two diagonal axes having such front-side openings that, of a pair of the upper and lower sides of the rectangular outline of the front-side opening of each slot, only the side situated on the side opposite to the horizontal axis side being inclined, relative to the horizontal axis, along the radiate line radiating from the center point toward the slot.

2. The shadow mask according to claim 1, wherein the side, situated on the side opposite to the horizontal axis side, of the rectangular outline of the front-side opening of each slot situated in the specified areas of the mask body is inclined at an angle in the range of $\alpha \pm 10°$, where $\alpha$ is the angle between the radiate line radiating from the center point toward the slot and the horizontal axis.

3. The shadow mask according to claim 2, wherein the mask body has a large number of slots in the specified areas of the mask body, and, of a pair of the upper and lower sides of the rectangular outline of the front-side opening of each one of the multiple slots made in the specified areas of the mask body, the side situated on the side opposite to the horizontal axis side forms, with an imaginary line extending in parallel with the horizontal axis, an angle that is greatest in the slots situated on the diagonal axes and gradually becomes smaller either continuously or step-wise as the slot position gets apart from the diagonal axes.

4. The shadow mask according to claim 1, wherein the mask body has a large number of slots in the specified areas of the mask body, the front-side openings and the backside openings of the multiples slots situated in the specified areas of the mask body are made by an etching process, and between the front-side openings of each two multiple slots situated in the specified areas of the mask body, arranged adjacently to each other in the direction parallel to the vertical axis passing through the center point of the mask body, extending along the mask body plane, is present a bridge portion remaining after the etching step.

* * * * *